US006601418B2

(12) United States Patent
Huang

(10) Patent No.: US 6,601,418 B2
(45) Date of Patent: Aug. 5, 2003

(54) STRUCTURE FOR ELECTRIC LOCK

(76) Inventor: Tsun Thin Huang, 6F, No. 3, Alley 10, Lane 265, Sec. 4, Hsin-I Rd., Taipei (TW)

( * ) Notice: Subject to any disclaimer, the term of this patent is extended or adjusted under 35 U.S.C. 154(b) by 0 days.

(21) Appl. No.: 09/946,456

(22) Filed: Sep. 6, 2001

(65) Prior Publication Data

US 2003/0070458 A1 Apr. 17, 2003

(51) Int. Cl.[7] ..... E05B 47/00

(52) U.S. Cl. ..... 70/280; 70/281; 70/282; 70/278.7; 292/144; 292/137

(58) Field of Search ..... 70/280, 281, 282, 70/278.7; 292/144, 165, 170, 169

(56) References Cited

U.S. PATENT DOCUMENTS 4,262,504 A * 4/1981 Inoue ..... 292/144
4,656,850 A * 4/1987 Tabata ..... 292/144
5,862,693 A * 1/1999 Myers et al. ..... 292/144
5,876,073 A * 3/1999 Geringer et al. ..... 292/144
6,079,755 A * 6/2000 Chang ..... 292/144
6,260,392 B1 * 7/2001 Geiger ..... 70/276

* cited by examiner

*Primary Examiner*—Anthony Knight
*Assistant Examiner*—Christopher Boswell
(74) *Attorney, Agent, or Firm*—Troxell Law Office PLLC

(57) ABSTRACT

An improved structure of electric lock disclosed herein employs only one electromagnetic coil and a DC power source formed of 4 3A-type dry battery unit for operating the lock instead of using two coils and an AC large power source along with a clumsy conductor layout, and a skilful arrangement of mutual positions between the driven rod and the extended portion of the actuated rod can produce an amplified driving torque effect from this minimized DC power source. Besides, the key function is controlled by a coded chip attached thereon to identify the visitor.

3 Claims, 5 Drawing Sheets

STRUCTURE FOR ELECTRIC LOCK

BACKGROUND OF THE INVENTION

1. Field of the Invention

The present invention relates to an improved structure of electric lock operatable with DC instead of AC, and controlled with a coded chip.

2. Description of the Prior Art

Locks are essential to the protection of human properties, so there have been so many kinds of locks in the market. Among these mechanically operated locks such as cylinder locks and modern electrically operated locks are the most prevailing types.

FIG. 1 is a schematic plane view of a conventional electrically operated lock commonly installed on a door. When the door is closed and in locked state, a tongue piece 11 is projected out, and a latch 12 located at the center thereof is retained by a circular detent washer 13 equipped at the center of a sub-lock case facing against a main lock case so that the latch 12 is captured. When unlocking the lock, by pushing a push button 14, and the latch 12 is released to retreat into the main lock case, thus the door can be opened.

Further detailed construction of a conventional electric lock is shown in FIG. 2. As shown in FIG. 2, two electromagnetic coils 15, 16, an actuated rod 17, a detention arm 18, and a tongue piece operation mechanism 3 are included in the main lock case. The actuated rod 17 is hinged to a pivot axis 171 and laid ahead of the electromagnetic coils 15 and 16 so that it is attracted by the coils 15 and 16 to move horizontally when the coils 15 and 16 are energized. The detention arm 18 approximately disposed perpendicular to the actuated lever 17, is also hinged to a pivot axis 181 and retains the front end of the actuated lever 17 with a jaw formed at its front terminal thereof, while its hinged end at the axis 181 is formed into a recessed breach 182 to trap one side of an inverse U shaped (⊓) frame 31 of the tongue piece operation mechanism 3.

The tongue piece operation mechanism 3 is composed of the inverted U-shaped frame 31, the latch 12, the tongue piece 11, a follower member 32 and a connecting rod 33. The inverted U-shaped frame 31 is formed into a narrow slot shape for the latch 12 to tunnel to and fro. The rear portion of the latch 12 is spirally encircled with a coil spring 34 whose one end is secured to the inner side of the rear ledge of the inverted U-shaped frame 31. The front leg of the inverted U-shaped frame 31 stands ahead of the first erecting member 321 of the follower member 32. A second erecting member 322 located behind the first erecting member 321 at a proper distance. The connecting rod 33 tunnels through the two erecting members 321 and 322 and is equipped with a coil spring 331 around its rear portion.

For understanding the operation principle of this lock, reference should be made to FIG. 3. When the lock is in the locked state with is latch 12 retained by the detent washer 13 in the sub-lock case, the ⊓ frame 31 exerts a backward pulling force by restoring force of the elongated spring 34. When unlocking, the electromagnetic coils 15, 16 are energized to attract the actuated rod 17 moving horizontally, the detention arm 18 is released to rotate in the counter clockwise direction. At this moment, the ⊓ frame 31 retreats backward together with the erecting member 321, follower member 32 and the tongue piece 11 and therefore the unlocking operation is completed. In the unlocked state, the spring 331 is compressed to store energy therein by the retreated tongue piece operation mechanism 3 ready for next coming locking operation.

However, a conventional electric lock constructed as such has the following apparent shortcomings:

1. A considerably strong current is required to attract the actuated rod with a larger torque because the two electromagnetic coils are necessarily installed near the pivoted axis of the actuated rod for operation.
2. Instead of DC, an AC power source is needed to supply such a large current, that necessitates an installation of large and long conductors 36 pulled through the door frame 38 to a power distribution box 37 (see FIG. 4). In this version, the outer appearance of the door frame 38 is spoiled and cost of labor and material is increased by such additional equipment. Besides, peeling of the jacket of the defected conductors 36 may probably lead to an accident.
3. To carry a key along is always bothersome; inadvertent loss of the key may result in loss of property and security as well. A mechanical key is not so dependable as a burglar or any person who happens to pick up the lost key might duplicate it.

In view of the above described shortcomings inherent to the conventional mechanical locks, the inventor of the present invention thus conducted intensive research and experimentation on electric locks. Through years of professional engagement in the manufacturing of related products, the inventor was finally proved to be present a much improved structure of electric lock of the present invention.

SUMMARY OF THE INVENTION

One objective of the present invention is to provide an improved structure of electric lock which employs only one electromagnetic coil and a DC power source for operating the lock instead of using two coils and an AC source.

The present invention is also aimed at operating an actuated rod with operating an amplified driving torque produced by the only one coil and a DC power source through elaborate arrangement of mutual positions between a driving rod and the actuated rod.

In addition, the key function of the present invention can controlled by a coded chip attached thereon.

To achieve the above mentioned objectives, the improved structure for electric lock comprises a tongue piece operation mechanism, an actuated rod, a detection arm, an electromagnetic coil and an electric circuit. The tongue piece operation mechanism further includes a tongue piece, a latch, a follower member and a connecting rod. The electromagnetic coil is situated at the same side of tongue piece operation mechanism with a driven rod tunneling through its center thereof. The driving rod is equipped with a spirally coiled spring at its rear end, and its front end is urging the bottom end of the extended portion of the actuated rod so that the electromagnetic coil is able to drive the driven rod to unlock and open the door with internally contained dry battery unit an thus the inconvenience of laying big conductors for AC current is eliminated. Finally, a read head is provided at a proper position in the lock case for reading the chip code of the key before unlocking.

DETAILED DESCRIPTION OF THE PREFERRED EMBODIMENTS

Figure 1:
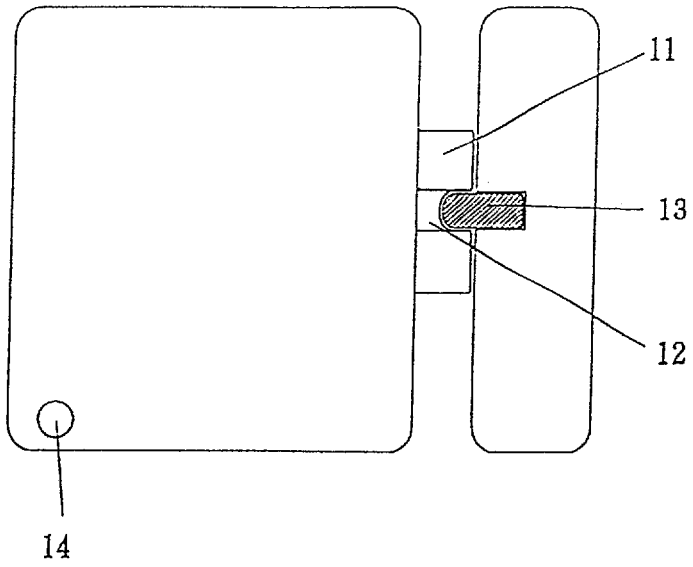
FIG. 1 is a plane view of a conventional electric lock.
Figure 4:
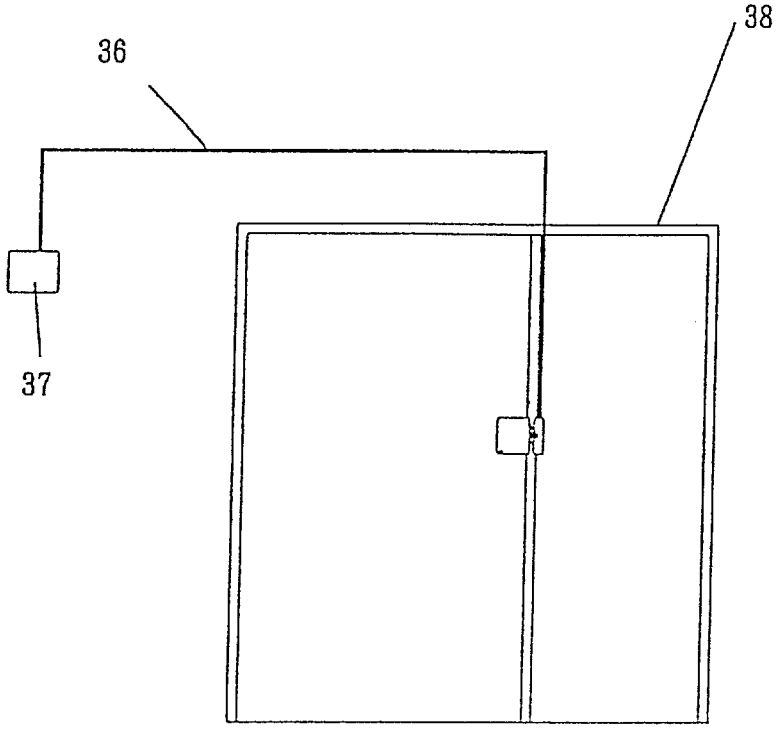
FIG. 4 is a schematic view demonstrating a clumsy installation for an AC power source required for a conventional electric lock.
Figure 2:
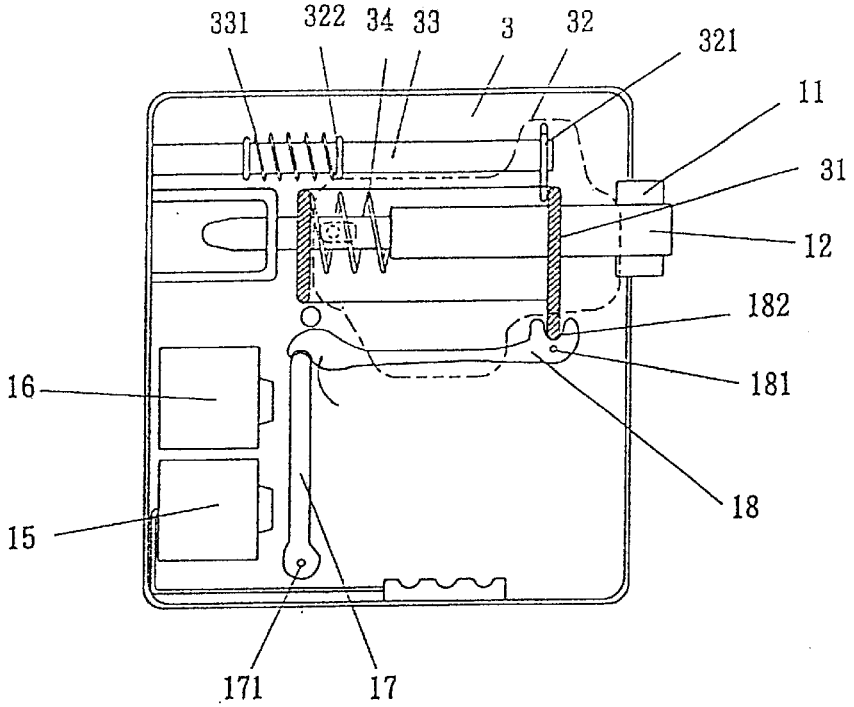
FIG. 2 is a plane view illustrating inner construction of a conventional electric lock.
Figure 3:
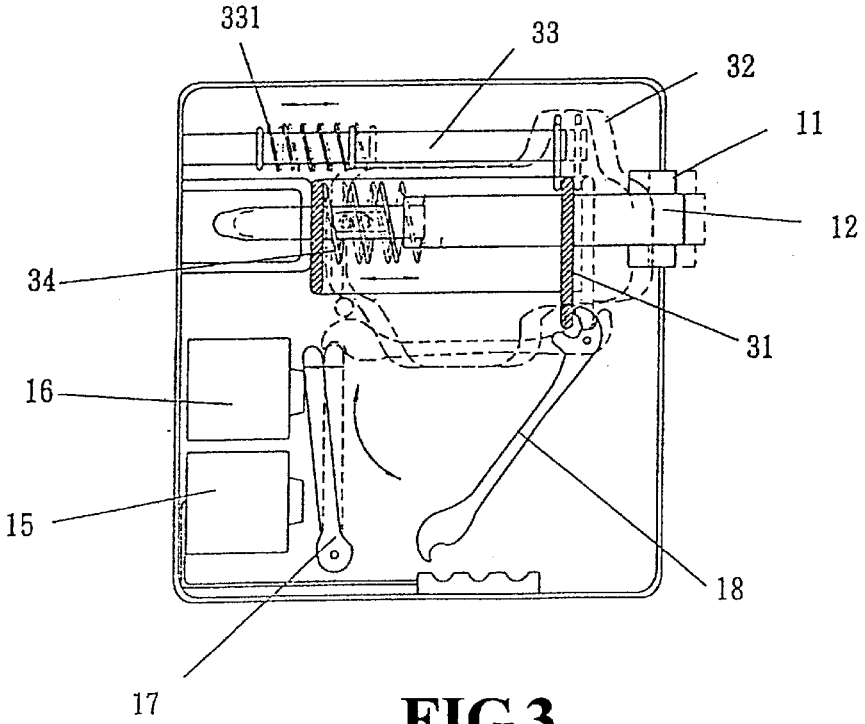
FIG. 3 is an illustrative view as to operation of the lock shown in FIG. 2.
Figure 5:
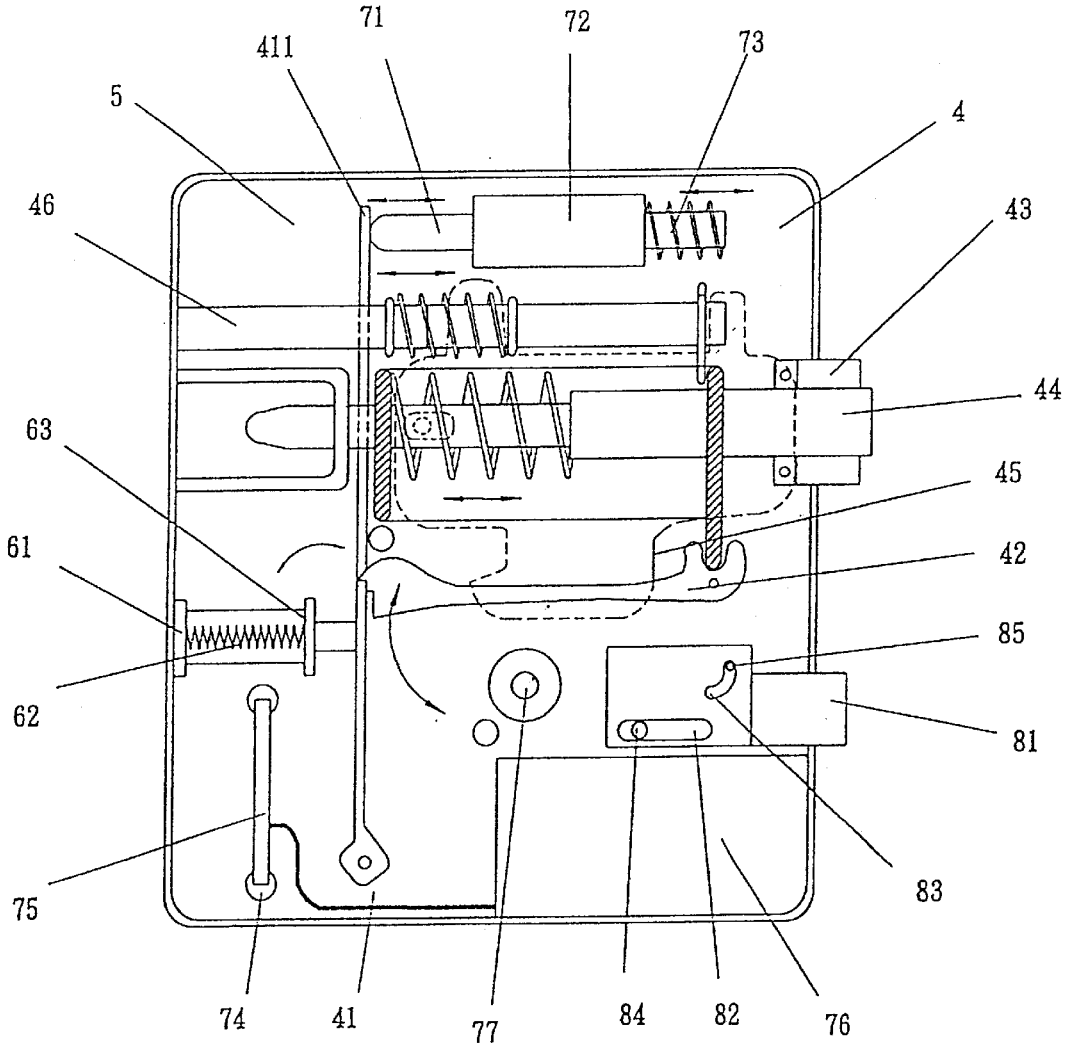
FIG. 5 is a plane view of the present invention.

Referring to FIG. 5, the improved structure of electric lock of the present invention comprises a tongue piece operation mechanism 4, an actuated rod 41, and a detention arm 42. The tongue piece operation mechanism 4 further includes a tongue piece 43, a latch 44, a follower member 45, and a connecting rod 46. The basic construction and mutual relationship among component parts similar to those of the conventional lock will not be described again; only the improved characteristics of the present invention are to be illustrated hereinafter.

Figure 6:
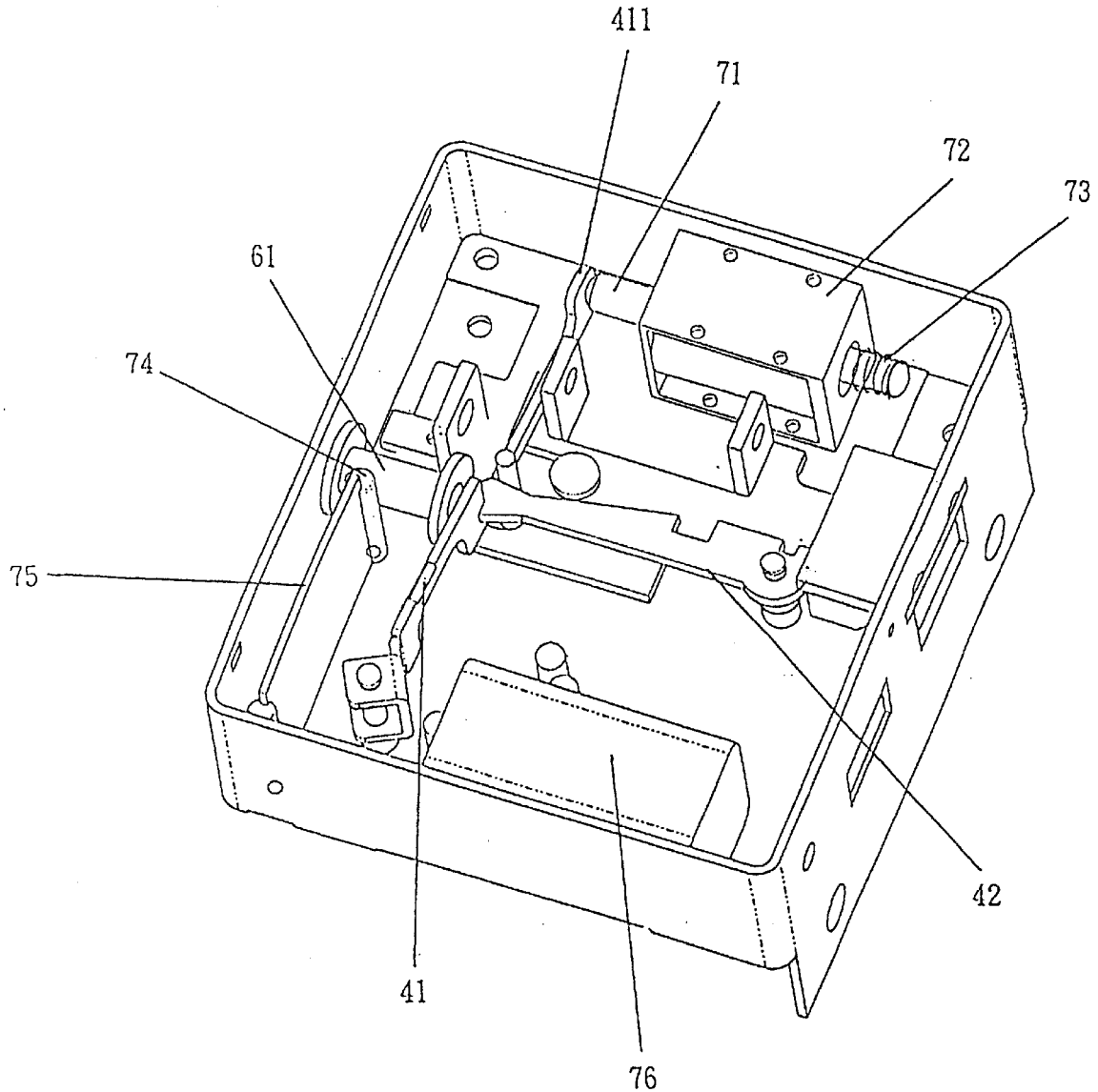
FIG. 6 is a three dimensional view of the present invention.
Figure 7:
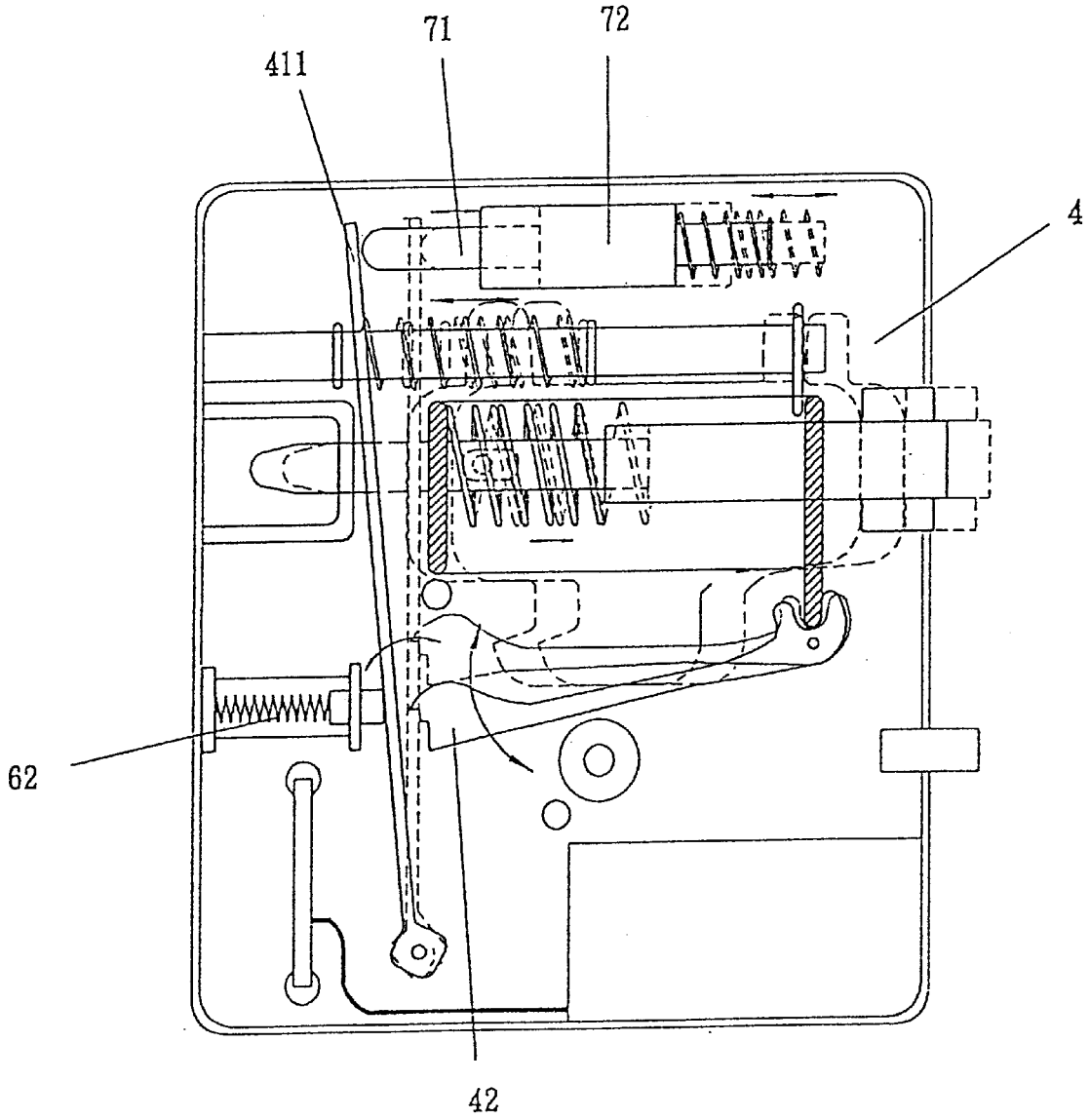
FIG. 7 is an illustrative view as to operation of the present invention.

Referring to FIG. 6 and FIG. 5, in lock case 5, there is a sleeve 61 attached to one end of the actuated rod 41. A coil spring 62 is equipped in the sleeve 61 to emerge an axle pin 63 thereby assisting the actuated rod 41 to settle down properly. The front end of the actuated rod 41 is formed into an extend portion 411 configuration in an upwardly concaved arcuate shape so as to evade interfering with the tongue piece operation mechanism 4; the end of the extended portion 411 thereof is mated with a driven rod 71 laying along an inner edge of the lock case 5.

The driven rod 71 is tunneling through an electromagnetic coil 72 installed at a position near the tongue piece 43 and slightly offsetting from the vertical center axis of the lock body 5.

Besides, an insertion slit 74 is formed abut to a side of the sleeve 61 for insertion of a circuit board 75, a battery compartment 76 is provided at another side of the lock case 5, and a read in head 77 (see FIG. 5) is equipped at a proper position in the lock case 5 for reading in information stored in a coded chip provided for the key.

A sub-lock mechanism 81 including a straight slot 82 and an arcuate slot 83 (see FIG. 5) is provided at a proper position in the lock case 5. The straight slot 82 is movable along a stationary pin 84 located therein, and the arcuate slot 83 is slidably by an actuation of a driving pin 85. A rotary switch button (not shown) is provided for the driving pin 85 for controlling its operation.

With this construction, when a person wants to go out from the building he/she may push a push button inside to unlock. In case a person is going to enter the building, he/she may use a key with coded chip to mate with the read in head 77 for access to the building.

As described above, the electromagnetic coil 72 and its driven rod 71 are just appropriately located at the most efficient position to push the distal end of the extended portion 411 of the actuated rod 41 so that a small current from the coil 72 is enough to produce necessary torque to push the rod 41. Therefore, 4 3A-type dry battery can durably last for operation more than 10,000 times.

In conclusions, the present invention employs only one electromagnetic coil and a DC power source formed of 4 3A-type dry battery unit for operating the lock instead of two coils and an AC large power source. Furthermore, by a skilful arrangement of mutual positions between the driven rod and the extension of the actuated rod, an amplified driving torque from this minimized DC power source is produced. Last of all, the key function can be controlled by a coded chip attached thereon to identify the visitor.

Those who are skilled in the art will readily perceive how to modify the invention. Therefore, the appended claims are to be construed to cover all equivalent structures which fall within the true scope and spirit of the invention.

What is claimed is:

1. An electric lock in a lock case comprising:

an electromagnetic coil;

an actuated rod;

a detection arm;

a tongue piece operation mechanism, the actuated rod is hinged to a pivoted axis and is retained by the detection arm at a front terminal thereof, the detection arm is also hinged to a pivoted axis and a hinged end is formed into a recessed breach to trap one side of an inverted U-shaped frame of the tongue piece operation mechanism;

the tongue piece operation mechanism further includes the inverted U-shaped frame, a latch, a tongue piece, a follower member, and a connecting rod, a center portion of the inverted U-shaped frame allows the latch to freely pass through, a rear portion of the latch is spirally encircled with a coil spring, a first end of the coil spring is secured to the inner side of the rear leg of the inverted U-shaped frame, a front leg of the inverted U-shaped frame stands ahead of a first erecting member of the follower member, a second erecting member is located behind the first erecting member such that a distance separates the first and second erecting members, the connecting rod passes through the two erecting members and is equipped with a coil spring around a rear portion, an end of the actuated rod has an extended portion configured in an upwardly concaved arcuate shape so as to evade interfering with the tongue piece operation mechanism, an end of the extended portion is mated with a driven rod laying along an inner edge of the lock case, the driven rod, being actuated by the electromagnetic coil and passing through it, is equipped with a coil spring at one end thereof, the electromagnetic coil is installed at a position near the tongue piece, a sleeve is attached to one end of the actuated rod, and a second coil spring is positioned in the sleeve to press an axle pin against the actuated rod to position the actuated rod, an insertion slit is formed adjacent to a side of the sleeve for insertion of a circuit board, and, a battery component is provided at another side of the lock case;

whereby, by forming an extended portion of the actuated rod and locating said electromagnetic coil and the driven rod to push a distal end of the extended portion to thus enable the lock to produce necessary torque to push the actuating rod to unlock with a small DC current and eliminate the use of AC power source with conductors.

2. The electric lock of claim 1, further comprising a read in head positioned in the lock case for reading in information stored in a coded chip provided with the key.

3. The electric lock of claim 1, further comprising a sub-lock mechanism including a straight slot and an arcuate slot provided in the lock case, the straight slot is movable relative to a stationary pin located therein, while the arcuate slot is slideably movable by actuation of a driving pin, and a rotary switch button is provided for the driving pin for controlling its operation.

* * * * *